US005447431A

United States Patent [19]

Muka

[11] Patent Number: 5,447,431

[45] Date of Patent: Sep. 5, 1995

[54] LOW-GAS TEMPERATURE STABILIZATION SYSTEM

[75] Inventor: Richard S. Muka, Topsfield, Mass.

[73] Assignee: Brooks Automation, Inc., Lowell, Mass.

[21] Appl. No.: 145,343

[22] Filed: Oct. 29, 1993

[51] Int. Cl.[6] ..... F27D 7/00; F27D 9/00; F27B 5/04

[52] U.S. Cl. ..... 432/4; 432/205; 432/253; 432/259; 432/80

[58] Field of Search ..... 432/205, 259, 59, 4, 432/80

[56] References Cited

U.S. PATENT DOCUMENTS

| | | | |
|---|---|---|---|
| 3,935,646 | 2/1976 | Grandine et al. | 432/205 |
| 4,490,111 | 12/1984 | Yokerna | 432/205 |
| 4,597,736 | 7/1986 | Moffat | 432/205 |
| 4,666,366 | 5/1987 | Davis | 414/749 |
| 4,715,812 | 12/1987 | von Matuschka | 432/259 |
| 4,721,462 | 1/1988 | Collins, Jr. | 432/253 |
| 4,770,630 | 9/1988 | Akimoto et al. | 432/205 |
| 4,909,701 | 3/1990 | Hardegen et al. | 414/749 |
| 5,090,900 | 2/1992 | Rudolf et al. | 432/253 |
| 5,180,276 | 1/1993 | Hendrickson | 414/752 |

*Primary Examiner*—Thomas N. Moulis
*Attorney, Agent, or Firm*—Nields & Lemack

[57] ABSTRACT

The temperature of articles in an "environmental" chamber is stabilized by evacuation of the "environmental" chamber, after having stabilized the temperature of such an article to approximate that of a controlled-temperature member spaced from the article by a small gap, to a pressure just sufficient to provide viscous gas behavior, adjusting the temperature of the article to closely match that of the member by gas conduction heat transfer across the gap, and evacuating the chamber to high vacuum.

7 Claims, 3 Drawing Sheets

LOW-GAS TEMPERATURE STABILIZATION SYSTEM

BACKGROUND OF THE INVENTION

1. Field of the Invention

The apparatus of the present invention relates generally to treatment of articles in a vacuum environment, and in particular to a system for stabilizing the temperature of such articles.

2. Description of Related Art

Numerous semiconductor manufacturing processes which produce pattern masks on transparent substrates require temperature stabilization of the substrate and protective carrier prior to pattern writing to prevent pattern distortion resulting from thermal expansion or contraction during the writing process. Temperature stabilization requirements are typically ±0.05 degrees C. relative to the writing chamber temperature.

The traditional temperature stabilization method utilizes long soak periods (>8 hours) in a temperature controlled "environmental" chamber at atmospheric pressure. This method removes initial temperature differences in the substrates and references the substrate temperature to the "environmental" chamber. In some configurations, the substrates and carriers are loaded by "hand" from a separate "environmental" chamber to a vacuum load lock where the atmosphere is evacuated. This "hand" loading can cause a significant temperature deviation of 0.1°–1.0° C. in the substrate from heat transferred from the operator's hand, typically 10°–15° C. above room ambient temperature. However, prior to writing the pattern, the gas environment must be evacuated from the load lock (typically to 1E–7 Torr) which cools the substrate due to gas expansion cooling. This evacuation typically causes a 6"×6"×0.090" thick glass plate to lose 0.6°–0.9 degrees C. Since production requirements typically require 2 or more substrates per hour, insufficient time is available for a second temperature stabilization soak process.

Also, substrate preheating attempts to offset the evacuation cooling effect are not totally effective since contact to the substrate image area (usually 90% or more of substrate) is prohibited which makes substrate temperature monitoring inaccurate and prevents surface contact heating methods. Also, gas convection heating exposes the substrate to particulate contamination from the gas supply or particulates in the chamber stirred by air currents.

SUMMARY OF THE INVENTION

The present invention comprehends evacuation of the "environmental" chamber to 50 Torr, then performing temperature stabilization, and then evacuating the remaining gas.

DETAILED DESCRIPTION OF THE PREFERRED EMBODIMENT

The low-gas temperature stabilization system of the invention utilizes non-contact (except for 3 support pins at the substrate outer edge) gas conduction heat transfer at reduced pressure across a small gap of 0.002–0.020" (depending on substrate size) between the substrate and a flat plate. The plate temperature is controlled by a liquid circulated to all parts of the writing chamber and associated handling system. Temperature stabilization occurs after evacuation from 760 to 50 Torr (93% of the gas). Gas conduction heat transfer remains 80–90% effective at this pressure since the gas in the small gap remains in the viscous regime. Viscous gas behavior requires a pressure which is greater than ten times the pressure at which the gas molecule mean free path is equal to the gap. The mean free path of molecules has been defined as the average distance where there is equal probability of a collision with the nearest body as with another gas molecule. The mean free path is a function of molecular diameter, gap and pressure. If the molecular diameter and pressure were such that the mean free path is equal to the gap, a gas molecule would have an equal probability of colliding with other gas molecules or the nearest surface, and viscous gas behavior would not be possible. If the pressure is greater than ten times the aforementioned pressure (at which the mean free path is equal to the gap), collisions with other gas molecules is sufficiently more frequent than collisions with the nearest surface that viscous gas behavior occurs. Mean free paths of representative gases as a function of pressure are disclosed, for example, at page 432 of "A User's Guide to Vacuum Technology" (second edition) by John F. O'Hanlon, published by John Wiley & Sons.

Figure 1:
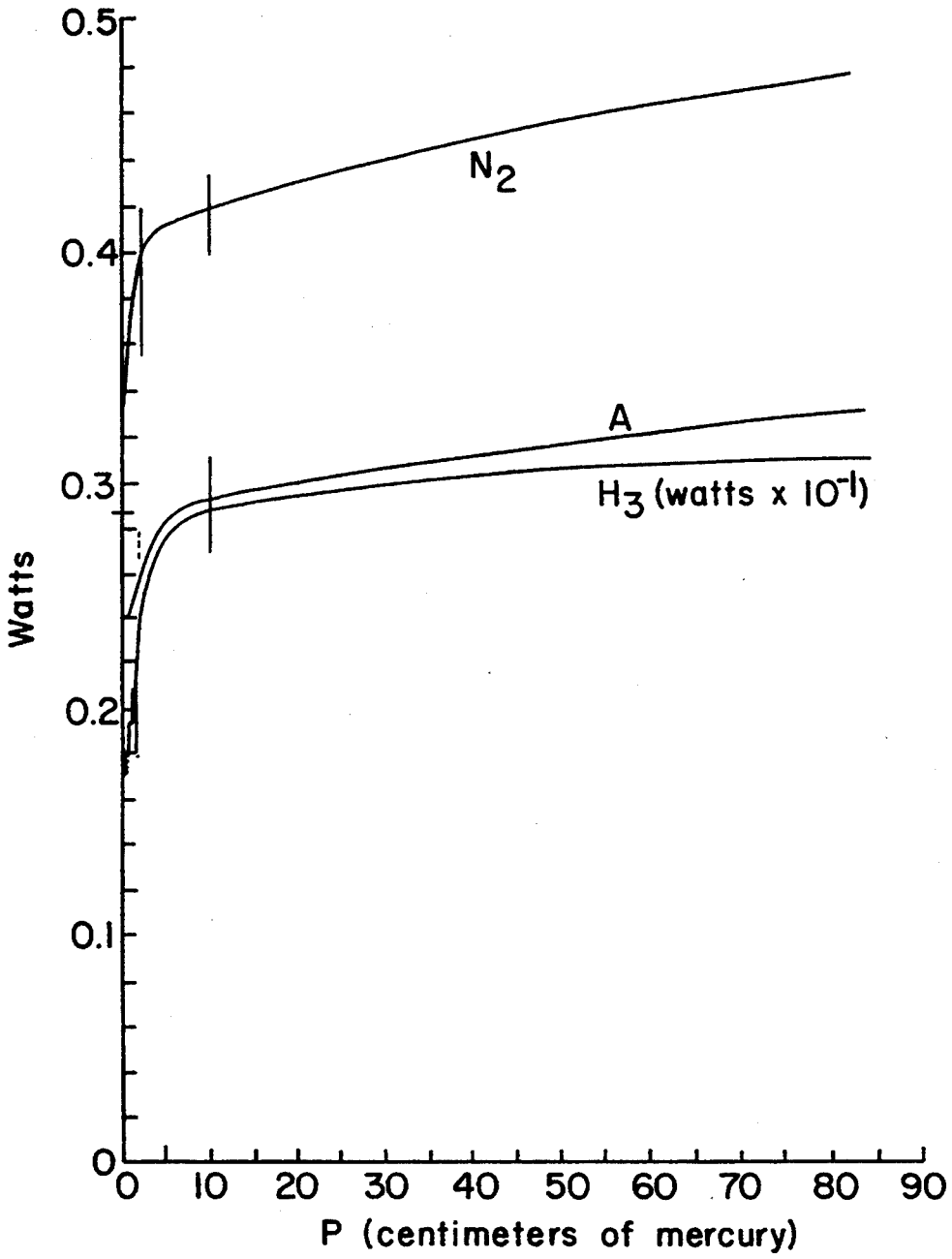
FIG. 1 is a graph showing gas thermal conductivity as a function of pressure.

FIG. 1 shows the variation of gas thermal conductivity with pressure. It is based upon Dushman, Saul, "Scientific Foundations of Vacuum Technology", John Wiley & Sons, 1962, and comprises plots illustrating the variation in thermal conductivity with pressure, for nitrogen, argon, and hydrogen. Gas conductivity is linearly proportional to heat transfer in watts as given in "Heat Transfer", Holman, p.9, McGraw-Hill. Ordinates give values of total watts conducted from a platinum filament located along the axis of a cylindrical glass tube. Scale of watts for hydrogen should be multipled by 10. Abscissas give pressures in centimeters of mercury. From the graph of FIG. 1 it can be seen that, in the case of nitrogen, a pressure drop from 760 Torr (1 atmosphere) to 50 Torr causes a reduction in conductivity of only 11.7% (from 0.47 to 0.415 watts).

Figure 2:
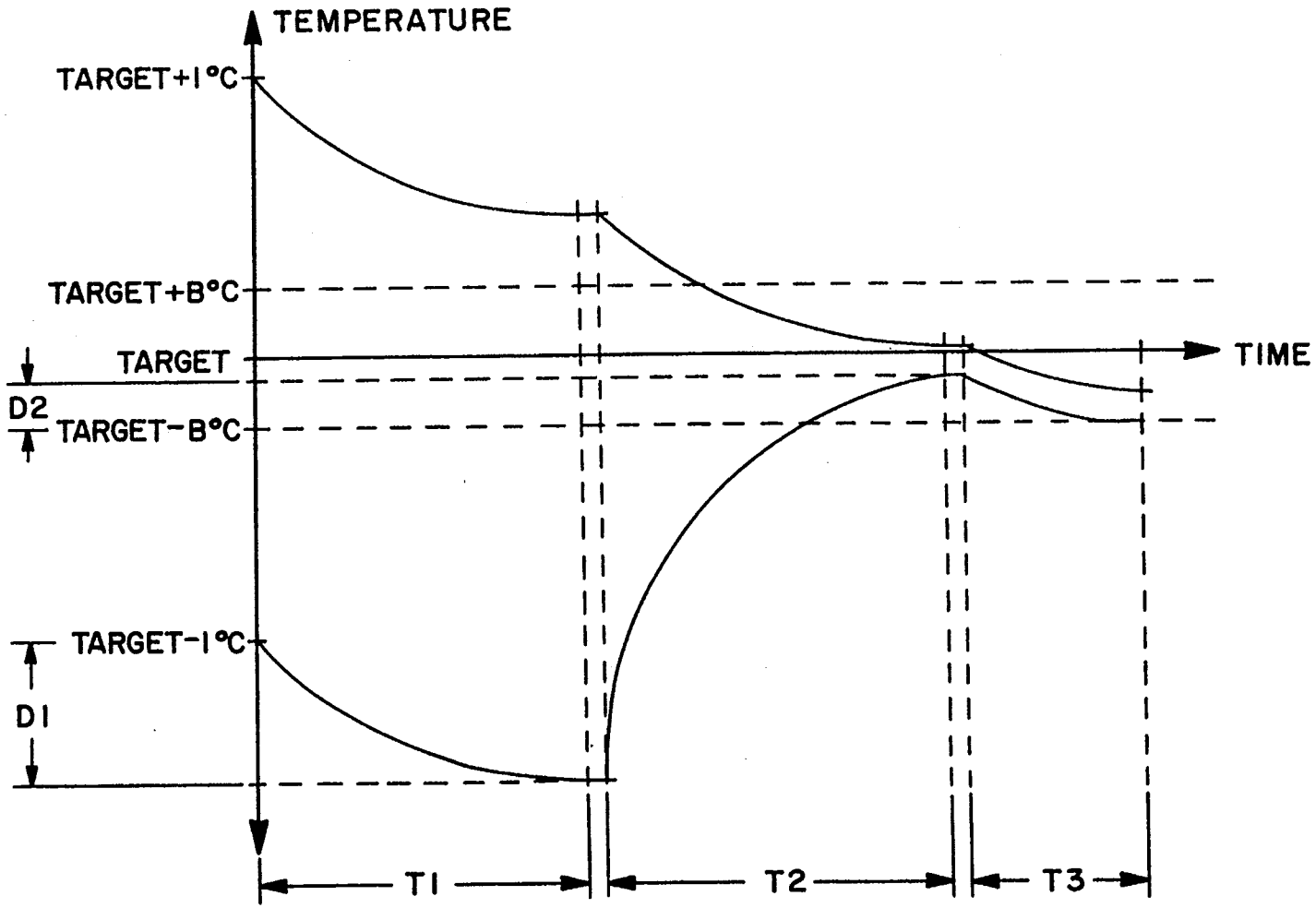
FIG. 2 is a graphic diagram showing temperature excursion of a typical mask or carrier sample.

Following substrate temperature stabilization of an initial temperature deviation and the initial gas evacuation cooling effect (due to evacuation from 760 to 50 Torr), an insignificant gas evacuation cooling effect occurs when the final evacuation reduces the pressure from 50 Torr to 1E–7 Torr. FIG. 2 shows a typical thermal transient response during temperature stabilization and gas evacuation cooling. A conventional pressure gage is sufficient to monitor gas pressure which indicates proper heat transfer performance.

Referring to FIG. 2, the graph therein shown plots temperature as a function of time during the temperature excursion of a typical mask or carrier sample. The tolerance on the target temperature is between a temperature of B° C. below target temperature and a temperature of B° C. above target temperature.

If the mask or carrier sample is initially at 1° C. above target temperature, pumpdown from atmosphere to 50 Torr will be accompanied by a temperature depression D1 during the pumpdown time T1. During the soak time T2 at 50 Torr, gas conduction heat transfer across the small gap of the invention causes temperature of the mask or carrier sample to fall further towards the target temperature as shown. Thereafter, during the pumpdown time T3 from 50 Torr to high vacuum the temperature falls still further, but remains within the tolerance on target temperature. This temperature depression during the pumpdown time T3 is shown as D2 in FIG. 2.

If the mask or carrier sample starts at 1° C. below target temperature, pumpdown from atmosphere to 50 Torr will again be accompanied by a temperature depression D1 during the pumpdown time T1. However, during the soak time T2 at 50 Torr, gas conduction heat transfer across the small gap of the invention causes temperature of the mask or carrier sample to rise towards the target temperature as shown. Thereafter, during the pumpdown time T3 from 50 Torr to high vacuum the temperature falls, but remains within the tolerance on target temperature; this temperature depression is again D2.

The low-gas temperature stabilization system provides an inexpensive, repeatable, non-contact means of adjusting a substrate and carrier temperature to the writing chamber reference temperature within 30 minutes for common substrate sizes. The system removes the substrate initial temperature deviation and the gas expansion cooling effects and results in a final temperature tolerance of ±0.05 degrees C.

Figure 3:
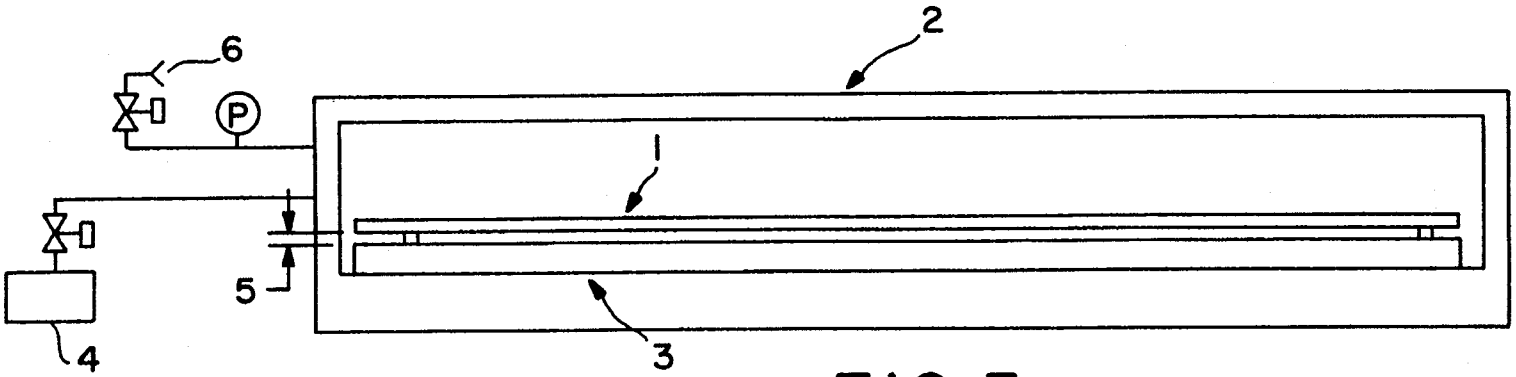
FIG. 3 is a somewhat diagrammatic view, partially in vertical section, of the low-gas temperature stabilization system of the invention.

Referring now to FIG. 3, therein is shown a low-gas temperature stabilization system of the invention. The substrate 1 is supported within a vacuum chamber 2 which includes a temperature controlled plate 3. Evacuation of the vacuum chamber to a pressure of 50 Torr is accomplished by the vacuum pump 4. The critical gap 5 is the space between the substrate 1 (a glass plate) and the cooled plate 3.

The mean free path of nitrogen at a pressure of 1 Torr and a temperature of 25° C. is 0.005 cm.(0.002 in.). Thus, if nitrogen from the gas supply 6 is introduced into the vacuum chamber 2, and if the critical gap is 0.005 cm, the pressure should be greater than ten times 1 Torr (i.e. 10 Torr) in order to maintain viscous behavior and thus to gain the maximum conductive (no gas currents) heat transfer rate in the gas. For the gas normally used in the low-gas temperature stabilization system the pressure is approximately 50 Torr for a 0.005–0.050 cm (0.002–0.020 inch) gap.

Movement into and out of the vacuum chamber 2 may be accomplished by any one of numerous devices described in the prior art for transferring substrates. For example:

U.S. Pat. Nos. 4,666,366 and 4,909,701 disclose substrate transfer handling apparatus having an articulated arm assembly which extends and retracts in a "froglike" motion to transfer an object such as a substrate between a plurality of locations. Two articulated arms are operatively coupled such that when one arm is driven by a motor the articulated arms extend and retract in a "froglike" or "frogkick" type of motion. A platform is coupled to the arms and has the object to be transferred disposed thereon. Still another substrate handling apparatus is disclosed in U.S. Pat. No. 5,180,276.

The use of electron beams for producing pattern masks on glass substrates has also been disclosed in the prior art. In a conventional procedure a piece of glass six inches square and 90 thousandths thick is coated with a chrome film upon which a photoresist is deposited. The photoresist may be a polymer which is crosslinked by electron radiation. The pattern is produced by an electron beam in vacuum. The electron accelerator may be a column having a diameter of one foot and a height of three feet, movable in the x,y direction. The glass is divided into tiles which are rastered by the electron beam, which has only a small motion. A developer removes the exposed photoresist and also the chromium under these parts. The remaining photoresist is then "ashed" and the mask is ready for repeated use. The writing takes 30 minutes.

The vacuum in which the pattern is produced by an electron beam is created in a suitable vacuum region, and the "environmental" chamber of the present invention may be arranged so that the operation of a suitable valve will place the "environmental" chamber in communication with the vacuum region, so that after the temperature of the glass substrate has been stabilized in the "environmental" chamber of the present invention, it may be transferred by one of the aforementioned substrate transfer handling apparatus in vacuo to the vacuum region in which the pattern is produced by an electron beam.

Figure 4:
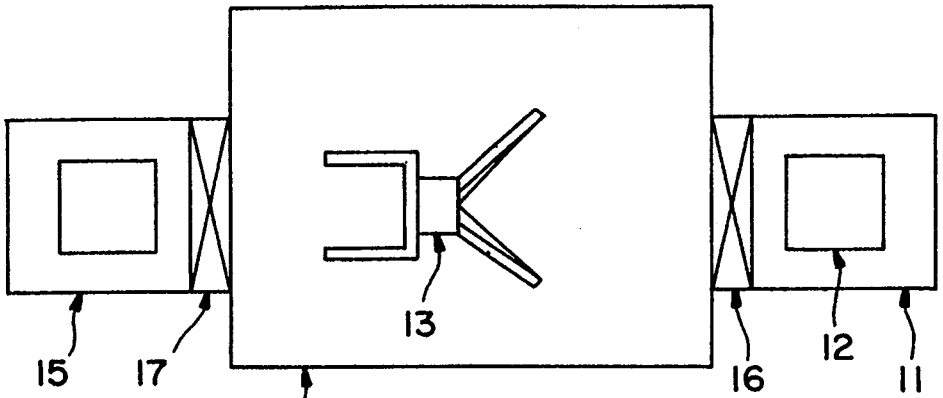
FIG. 4 is a somewhat diagrammatic top view of a material handling system which makes use of the low-gas temperature stabilization system of the invention.

Referring now to FIG. 4, therein is shown a system for producing pattern masks on glass substrates which makes use of the low-gas temperature stabilization system of the invention. Referring thereto, the environmetal and load lock chamber 11 may have incorporated therein the various features of the invention shown in FIG. 3. It is capable of being placed in communication with a vacuum chamber 14 by means of a vacuum valve 16. An additional vacuum valve 17 is provided between the vacuum chamber 14 and an electron-beam writing chamber 15. Initially a substrate 12 upon which a pattern mask is to be produced is placed in the environmental chamber 11 as shown in FIG. 4, the vacuum valve 16 is closed, and the environmental chamber 11 is evacuated in the manner hereinbefore described in connection with FIG. 3. Meanwhile, suitable evacuation of the vacuum chamber 14 and the electron-beam writing chamber 5 is carried out. When temperature stability of the substrate 12 has been achieved, the vacuum valve 16 is opened and the robot 13 is activated so as to transfer the substrate 12 from the environmental chamber 11 into the electron-beam writing chamber 15 through the open vacuum valve 17 in a manner well known in the prior art and disclosed, for example, in the aforementioned U.S. Pat. Nos. 4,666,366 and 4,909,701. The vacuum valve 17 may then be closed, and the electron-beam writing carried out.

Having thus described the principles of the invention, together with illustrative embodiments thereof, it is to be understood that although specific terms are employed, they are used in a generic and descriptive sense and not for purposes of limitation, the scope of the invention being set forth in the following claims.

I claim:

1. That method of stabilizing the temperature of an object spaced from a controlled-temperature member by a small gap in a vacuum region before evacuation thereof to the desired vacuum and while the region is at a pressure which is greater than ten times the pressure at which the gas molecule mean free path is equal to the gap and which therefore provides viscous gas behavior, comprising the following steps:

placing an object 1 in a chamber 2 having a controlled-temperature member 3 so that said object is spaced from said member by a small gap 5, maintaining said member at a target temperature by liquid circulation, evacuating the chamber to a pressure just sufficient to provide viscous gas behavior, adjusting the temperature of the object to match that of said member by gas conduction heat transfer across said small gap, and then evacuating the chamber to the desired vacuum.

2. That method of treating an object in a vacuum region, at a specified temperature, said vacuum region having a specified vacuum, comprising the following steps:

placing an object 1 so as to be spaced from a controlled-temperature number 3 by a small gap 5 in a chamber 2 comprising a vacuum region before evacuation thereof to the desired vacuum and while the region is at a pressure which is greater than ten times the pressure at which the gas molecule mean free path is equal to the gap and which therefore provides viscous gas behavior, said chamber 2 having such a controlled-temperature member 3, maintaining said member at a target temperature by liquid circulation, evacuating the chamber to a pressure just sufficient to provide viscous gas behavior, adjusting the temperature of the object to match that of said member by gas conduction heat transfer across said small gap, and then transfering the object to the vacuum region.

3. A method in accordance with claim 1, wherein said pressure is of the order of $10^2$ Torr and wherein said small gap is in the range between 0.002 inch and 0.020 inch.

4. A method in accordance with claim 3, wherein said pressure is about 50 Torr and said small gap is about 0.020 inch.

5. A method in accordance with claim 2, wherein said pressure is of the order of $10^2$ Torr and wherein said small gap is in the range between 0.002 inch and 0.020 inch.

6. A method in accordance with claim 5, wherein said pressure is about 50 Torr and said small gap is about 0.020 inch.

7. That method of stabilizing the temperature of an object spaced from a controlled-temperature member by a small gap in a vacuum region before evacuation thereof to the desired vacuum and while the region is at a pressure which is greater than ten times the pressure at which the gas molecule mean free path is equal to the gap and which therefore provides viscous gas behavior, comprising the following steps:

placing an object 1 in a chamber 2 having a controlled-temperature member 3 so that said object is spaced from said member by a small gap 5, maintaining said member at a target temperature by liquid circulation, evacuating at least 90% but less than 95% of the gas in the chamber, adjusting the temperature of the object to match that of said member by gas conduction heat transfer across said small gap, and then evacuating remaining gas in the chamber until the desired vacuum is attained.

* * * * *